US005305560A

United States Patent [19]

Roelofs

[11] Patent Number: 5,305,560

[45] Date of Patent: Apr. 26, 1994

[54] METHOD OF SPLICING ENDLESS ABRASIVE BELTS AND CONES

[75] Inventor: Glenn E. Roelofs, Oakdale, Minn.

[73] Assignee: Minnesota Mining and Manufacturing Company, St. Paul, Minn.

[21] Appl. No.: 61,700

[22] Filed: May 13, 1993

Related U.S. Application Data

[63] Continuation of Ser. No. 697,703, May 9, 1991, Pat. No. 5,256,227.

[51] Int. Cl.[5] ..... B32B 31/12

[52] U.S. Cl. ..... 51/399; 51/298; 51/297; 156/157

[58] Field of Search ..... 51/399, 295, 297, 298; 156/157, 304.1-304.3-304.6, 307.3, 307.5, 331.1, 331.4, 331.7

[56] References Cited

U.S. PATENT DOCUMENTS

| | | | |
|---|---|---|---|
| 2,309,305 | 3/1941 | Dahlstrom et al. | 51/188 |
| 2,350,861 | 6/1944 | Argy et al. | 156/304.6 |
| 2,794,126 | 6/1957 | Riedesel et al. | 51/399 |
| 3,154,897 | 11/1964 | Howard | 51/399 |
| 3,640,924 | 2/1972 | Hermann | 156/331.7 |
| 3,763,604 | 10/1973 | Malloy | 51/399 |
| 4,185,718 | 1/1980 | Cawthra et al. | 156/304.4 |
| 4,194,618 | 3/1980 | Malloy | 206/205 |
| 4,543,144 | 9/1985 | Thoma et al. | 156/307.5 |
| 4,623,416 | 11/1986 | Henning et al. | 156/331.7 |
| 4,870,129 | 9/1989 | Henning et al. | 156/331.7 |

FOREIGN PATENT DOCUMENTS

| | | | |
|---|---|---|---|
| 3340432 | 5/1985 | Fed. Rep. of Germany | 51/405 |

*Primary Examiner*—Robert A. Rose

*Attorney, Agent, or Firm*—Gary L. Griswold; Walter N. Kirn; Jeffrey L. Wendt

[57] ABSTRACT

Splices of endless abrasive belts and cones can be formed without emission of organic volatiles by employing as the splicing adhesive an aqueous adhesive dispersion that is a blend of a polyurethane and a polyisocyanate crosslinking agent.

2 Claims, 1 Drawing Sheet

METHOD OF SPLICING ENDLESS ABRASIVE BELTS AND CONES

This application is a continuation of U.S. application Ser. No. 07/697,703, filed May 9, 1991, now U.S. Pat. No. 5,256,227.

BACKGROUND OF THE INVENTION

1. Field of the Invention

The invention concerns the manufacture of endless abrasive belts and cones and is particularly concerned with the splicing of the ends of a length of coated abrasive sheet material to form an endless belt or cone.

2. Description of the Related Art

For many years, endless abrasive belts and cones have been made by splicing the ends of lengths of coated abrasive sheet material. Two types of splices are common. In the so-called "lap" splice, the ends of the length are beveled by removing abrasive granules from one end and part of the backside from the other end, and the beveled ends are overlapped and joined adhesively as illustrated in U.S. Pat. No. 2,309,305 (Dahlstrom et al.). In the so-called "butt" splice, the backside at each end of a length of coated abrasive sheet material is scuffed to form a hollowed out space which is filled with an adhesive plus a strong, thin, tear-resistant splicing tape. Typically, each type of splice is formed in a heated splicing press to be of substantially the same thickness as the remainder of the belt or cone.

Most backings of endless abrasive belts and cones are cloth, paper, polymeric film, or laminates thereof. Cloth backings provide the most durable backings but are expensive and, to have suitably smooth surfaces, may require a series of coating treatments that can make cloth backings even more expensive. Paper and laminates of polymeric film and paper afford intermediate durability and are often used where cloth would be too expensive. For light duty, backings can be polymeric film, the backside of which usually has a resinous coating that is porous.

It is believed that most splices of current manufacture are made with an organic solvent solution of adhesive that penetrates into pores of the backing to enhance the strength of the splice. Heat is then applied to volatilize the organic solvent which pollutes the atmosphere unless expensive recovery apparatus is employed. Unfortunately, organic solvent vapors are inflammable so that their recovery is hazardous, but their release into the atmosphere is becoming environmentally unacceptable. The use of adhesive solutions for splicing endless abrasive belts is described in coassigned U.S. Pat. No. 3,154,897 (Howard) and in U.S. Pat. No. 3,763,604 (Malloy).

In U.S. Pat. No. 4,194,618 (Malloy), endless abrasive belts are spliced using a partially cured, heat-activatable preformed adhesive film which does not evolve any solvent. It is believed that such dry bonding films are little used in the manufacture of endless abrasive belts, perhaps due to a concern that a dry adhesive might not penetrate sufficiently into the backing to prevent the splices from failing prematurely when exposed to the heat, flexural fatigue, and other rigors to which belts and cones are subjected in ordinary usage.

SUMMARY OF THE INVENTION

The invention permits lengths of coated abrasive sheet material to be spliced to form endless abrasive belts and cones, with substantially no emission of organic volatiles and without any sacrifice in quality. As in the prior art, to make a splice, part of each end of each length of coated abrasive sheet material is removed to provide splicing surfaces. For a lap splice, each splicing surface preferably is beveled. For a butt splice, part of the backside at each end of the coated abrasive can be removed by skiving, grinding, or scuffing (e.g., by sandblasting or by abrading) to form a hollow into which a splicing tape can be fitted. Either type of splice is then made by the steps of a) coating onto said splicing surfaces an aqueous adhesive dispersion that is substantially free from volatile organic matter, which aqueous dispersion comprises a blend of a polyurethane (preferably polyester polyurethane) and a polyisocyanate crosslinking agent, b) juxtaposing the two ends, and c) curing the adhesive coatings.

In step a), the aqueous adhesive dispersion can be applied to the splicing surfaces by brushing, roll coating, spraying, knife coating, or other coating techniques. Roll coating is preferred, being fast, easy, and uniform. When the backing is porous, preferably two coatings of the aqueous adhesive dispersion are applied, and the first coating is allowed to dry for about 5 to 10 minutes before applying the second. This ensures both good penetration into the backing and a uniform "glue line thickness" at the splice of from 5 to 150 μm, preferably from 25 to 100 μm. At a "glue line thickness" substantially outside of these preferred ranges, the splice might not possess the desired durability.

Prior to step c), the second coating of the aqueous adhesive dispersion should be allowed to stand at room temperature for a time to allow most of the water to evaporate, anywhere from 10 to 120 minutes, but preferably at least 30 minutes. If allowed to stand for substantially longer than 120 minutes, the adhesive coatings might cure to the point that they can no longer form strong bonds.

Preferably, the aqueous adhesive dispersion has a viscosity of from 100 to 1000 cps, more preferably from 400 to 600 cps, within which range it penetrates quickly into a porous backing such as paper, thus both reinforcing the backing at the splice and enhancing the strength of the adhesive bond. A viscosity above 1000 cps might not afford adequate penetration, whereas an aqueous adhesive dispersion below 100 cps might wick onto the coated side of the belt or cone and thus contaminate the abrasive coating.

Preferably, the aqueous adhesive dispersion comprises from 20% to 80% solids, more preferably from 30% to 50% solids. At substantially below 30% solids, it might be difficult to attain a uniform "glue line" thickness. At substantially above 50% solids, it might be difficult to attain a viscosity of less than 1000 cps.

Then in step c), the adhesive coatings can be cured in a heated splicing press in which the juxtapositioned ends are allowed to dwell for a few seconds to drive off substantially all remaining water before applying pressure. From 2 to 5 seconds dwell should allow the adhesive coatings to become substantially free from water. Sufficient pressure should be applied to ensure that there is no discontinuity in either face of the abrasive belt or cone at the splice.

Best results have been achieved in the invention when the polyurethane has been an aliphatic polyester urethane, preferably a linear aliphatic polyester urethane. Linear aliphatic polyester urethanes based on hexamethylene diisocyanate and isophorone diisocyanate are available as DISPERCOLL KA-8464 (softening point about 85° C.) and KA-8481 (softening point about 106° C.) from the Plastics and Rubber Div. of Mobay Corp., Pittsburgh, Pa. Each of these aliphatic polyester urethanes incorporates into the polyurethane polymer backbone an ionic group, which can be cationic or anionic, preferably is anionic, and acts as an internal emulsifier. The polyester polyurethane of the aqueous adhesive dispersion should have a high softening point, typically in the range of 40° to 150° C., preferably from 80° to 120° C. Splices having the highest tensile strengths have been achieved within this preferred range.

The pH of the aqueous adhesive dispersion should be kept in the range of 5.0 to 9.0, because either highly acidic or highly alkaline conditions could result in hydrolytic degradation of the polyurethane polymer.

Preferred crosslinking agents are polyisocyanates having two or more functional groups. Crosslinking is necessary to attain the good durability, heat resistance, water resistance, and chemical resistance by which splices of the invention are characterized. Considering that the polyester polyurethane can be aliphatic, it is surprising that splices obtained in the course of the present invention are equal to those of the prior art that are made using aromatic polyurethanes coated from organic solvents.

Preferred polyisocyanate crosslinking agents are available from Mobay under the trade name DESMODUR DA and ICI Chemicals under the trade designation PBA-2259.

The polyisocyanate crosslinking agent should be used in amounts between 1 and 20 parts per 100 parts by weight of the polyurethane, preferably from 1 to 10 parts, and more preferably from 2 to 6 parts. At less than 1 part, the splice adhesive might not develop adequate resistance to temperatures to which abrasive belts and cones are heated in use, whereas large amounts might result in unduly short pot life.

Preferably the aqueous adhesive dispersion of the present invention contains a wetting agent such as INTERWET 33 from Chemie America Interstab Chemicals, FLUORAD from 3M Co.; or AEROSOL OT from Rohm Haas. Preferably a wetting agent is used in amounts between 0.1 and 2 parts per 100 parts by weight of the polyurethane. It may also be desirable to employ a defoaming agent.

BRIEF DESCRIPTION OF THE DRAWING

The invention may be more easily understood in reference to the drawing, all figures of which are schematic. In the drawing.

DESCRIPTION OF THE PREFERRED EMBODIMENTS

Figure 1:
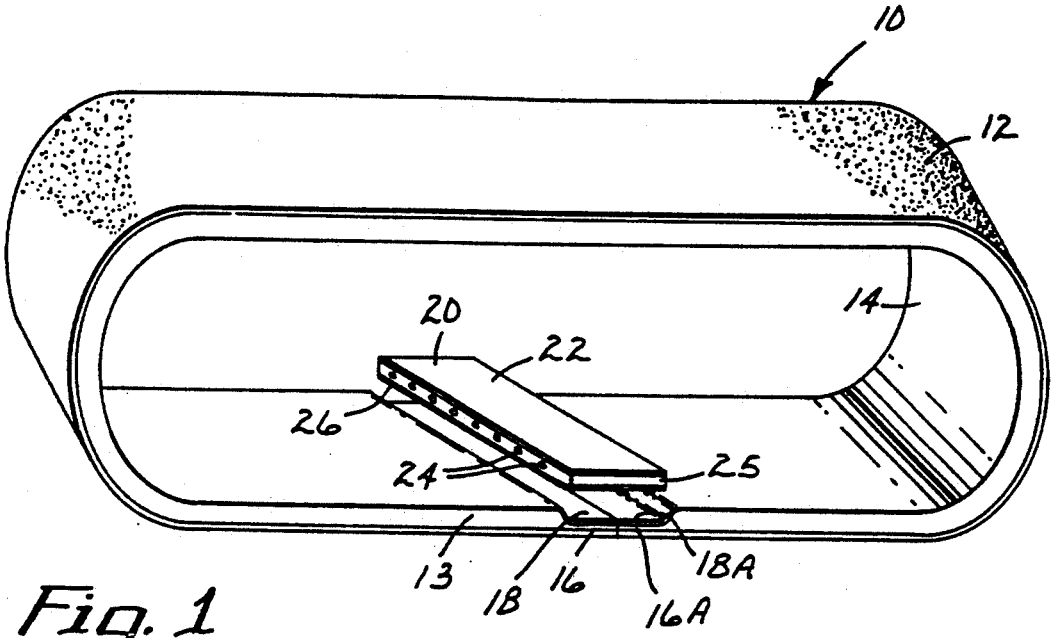
FIG. 1 is an isometric view of the ends of a length of coated abrasive sheet material and a piece of splicing tape in position to make an abrasive belt having a butt splice of the invention.

In FIG. 1, a length 10 of coated abrasive sheet material bearing abrasive granules 12 has been prepared for splicing by scuffing the backing 13 at its backside 14 at each end 16 and 16A, which ends extend at 65° to the sides of the length. Polyurethane adhesive coatings 18 and 18A have been applied from aqueous adhesive dispersion onto the scuffed splicing surfaces of the ends 16 and 16A, respectively.

A piece of splicing tape 20 has a plastic film backing 22, to which a monolayer of reinforcing yarns 24 have been bonded by a binder 25. Covering the yarn-binder layer is an adhesive coating 26.

With the ends 16 and 16A in juxtaposition, the scuffed splicing surfaces form a hollow into which the piece of splicing tape 20 fits. In doing so, the adhesive coating 26 of the splicing tape contacts the adhesive coatings 18 and 18A on the splicing surfaces. Upon applying heat and pressure, the adhesive coatings 18, 18A and 26 become blended into one layer 27 of the butt splice 28 of the abrasive belt 29 shown in FIG. 2. The reinforcing yarns extend substantially parallel to the side of the abrasive belt 29.

Figure 3:
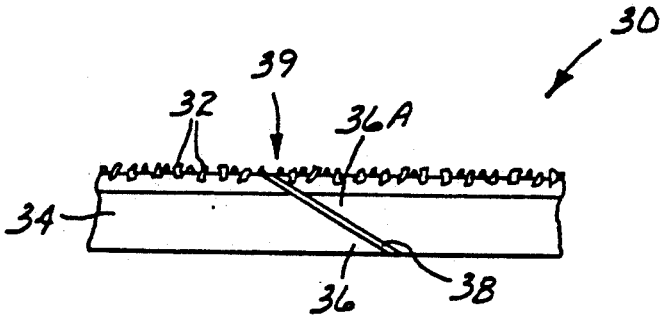
FIG. 3 is a fragmental edge view of an abrasive belt having a lap splice of the invention.

In FIG. 3, a length 30 of coated abrasive sheet material has beveled splicing surfaces, one of which has been formed by removing abrasive granules 32 and part of the faceside of the backing 34 from one end 36 of the length. The other beveled splicing surface has been formed by removing part of the backside of the backing at one end 36A of the length. Each of the beveled splicing surfaces has been coated with an aqueous adhesive dispersion. With the coated splicing surfaces overlapped, heat and pressure has been applied, thus causing the contacting adhesive coatings to blend together to form an adhesive layer 38 of a lap splice 39.

TENSILE TEST

To test a splice, a strip 1 inch in width and 7 inches length is cut across the splice to extend in the lengthwise direction of an abrasive belt or cone containing the splice. The strip is pulled on a Sintech Tensile Tester at a crosshead speed of 2 in/min. and then examined. Breaking of the backing indicates that the splice is at least as strong as the backing. This Tensile Test is run either at room temperature or in an oven at 200° F. after the test sample has been in the oven for about 3 minutes. Abrasive belts and cones often are exposed to temperatures of about 200° F. in use, and the ability of a splice to maintain good tensile strength at that temperature is commonly specified by users.

In the following examples, all parts are by weight.

EXAMPLE 1

Figure 2:
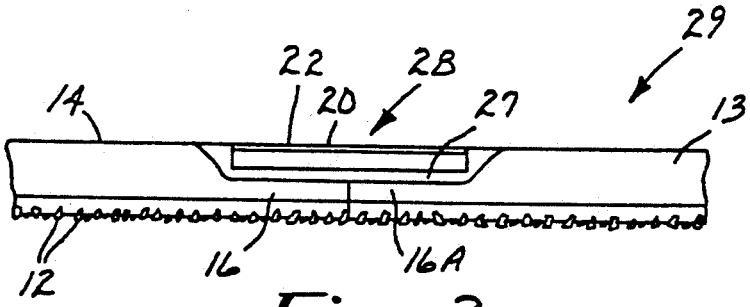
FIG. 2 is an edge view of the completed butt splice of FIG. 1.

Used to make a butt splice as illustrated in FIG. 2 of the drawing was a splicing tape made from Sheldahl splice medium No. T-1788 that has a backing of 3.5 mils in thickness. The backing consisted of biaxially oriented poly(ethylene terephthalate) film to which a monolayer of high-tenacity yarns have been bonded by a binder. To convert the splicing strip to a splicing tape, the yarn-binder layer was coated with the following adhesive solution:

| | Parts |
|---|---|
| adipic acid-ethylene glycol-polyester-diisocyanate reaction product having hydroxyl functionality, as a 22% solids solution in ethyl acetate, the reaction product being further described in U.S. Pat. No. 2,919,408 | 100 |
| triphenyl methane triisocyanate, as a 20% solution in methylene chloride | 7 |

The coating was then dried in air to a thickness of 1–2 mils, thus rendering it substantially free from volatile material. The splicing tape had a width of ¾ inch.

An aqueous adhesive dispersion was prepared by blending together

| | Parts |
|---|---|
| aliphatic polyester urethane based on hexamethylene diisocyanate and isophorone diisocyanate (DISPERCOLL KA-8464) | 100 |
| diphenylmethane diisocyanate crosslinking agent (PBA-2259 from ICI Chemicals) | 6 |
| wetting agent (INTERWET 33) | 1 |

A butt splice as illustrated in FIG. 2 of the drawing was made from two lengths of coated abrasive sheet material that is currently used in commerce to make abrasive belts. The backing of the coated abrasive sheet material was a laminate of 3-mil biaxially oriented poly-(ethylene terephthalate) film and 3-mil Fourdrinier paper that had been impregnated with resinous material and formed the backside of the coated abrasive sheet material. One end of each length was cut at an angle of 65° to its sides. The backside at each of the cut ends was scuffed using an abrasive belt to form a beveled splicing surface that was approximately 10 mils in depth at the cut end tapering to zero depth at 0.5 inch from the cut end. The scuffing exposed the core of the paper which was only partially impregnated and hence quite porous.

The aqueous adhesive dispersion was roll coated onto each of the beveled splicing surfaces using a short napped paint roller, and the coatings were air dried for about 5 to 10 minutes. A second coating was applied over the first in the same way and air dried for about 60 minutes. The ends were then juxtaposed, and a piece of the splicing tape was laid into the groove formed by the two beveled splicing surfaces with its adhesive coating face-to-face with the adhesive coatings on the splicing surfaces. In a heated press, the bottom bar temperature of which was 200° F., after three seconds exposure to the heat, the press was closed for 12 seconds at 1.5 tons per inch of splice length, thus causing the adhesives to become blended together to form a butt splice.

EXAMPLES 2–6

A series of splices were made using one aqueous adhesive dispersion described in Example 1 except changing the amount of the crosslinking agent in the aqueous adhesive dispersion as indicated in Table I. Examples 3 and 4 were butt splices made as described in Example 1. Examples 2,5 and 6 were butt splices made with uncoated backing ends which had been scuffed as shown in FIG. 1, and one end of each butt splice rotated 90° to make a splice with opposed scuffed ends overlapped to provide a lap splice. Tensile testing results showed that the results obtained with a butt splice were comparable to the results obtained with this overlap splice. Example 4 was a repeat of Example 1.

COMPARATIVE EXAMPLE A

A butt splice was made in the same way as in Example 1 except that the aqueous adhesive dispersion was replaced by the adhesive solution used in Example 1, which adhesive solution is currently being used to make butt splices commercially.

Tensile Tests (averages of about 6 specimens) of the butt splices of Examples 2–6 and Comparative Example A are reported at room temperature (R.T.) and at 200° F. in Table I.

TABLE I

| Example | Parts X-link Agent | Tensile Test in lbs./in. at R.T. | Tensile Test in lbs./in. at 200° F. |
|---|---|---|---|
| 2 | 0 | 135[1] | 13 |
| 3 | 2 | 138[1] | 74 |
| 4 | 6 | 143[1] | 78 |
| 5 | 10 | 145[1] | 73 |
| 6 | 15 | 140[1] | 75 |
| A | | 130[2] | 68 |

[1]paper backing broke outside splice area
[2]paper backing delamination beneath splice tape

EXAMPLE 8

An abrasive belt was made with a backing and butt in Example 1. It was 3 inches in width and 120 inches in length. Used for comparative purposes was a commercial abrasive belt made in the same way except having a butt splice as in Comparative Example A.

Each belt was rotated in a triangular course around a pair of steel rolls and a graphite pad (1-inch radius) while applying sufficient tension to heat the belt to a temperature of 250°–300° F. Each of several samples of the abrasive belt of this example had not broken after running for one hour when the test was discontinued, whereas most samples of the commercial abrasive belt broke.

EXAMPLE 9

A butt splice was made in the same way as in Example 1 except that the coated abrasive sheet material was a Production Resinite E weight paper commercially available from 3M Co. In the Tensile Test, its tensile strength at R.T. was 125 lbs./in. and at 200° F. was 87 lbs./in., and the failure of each was at the splice. The tensile strength of the paper backing alone at R.T. was 178 lbs./in. and at 200° F. was 135 lbs./in.

EXAMPLE 10

A butt splice was made in the same way as in Example 1 except that the coated abrasive sheet material was a 270D having a Y weight Resin Bond Cloth cloth backing commercially available from 3M Co. In the Tensile Test, its tensile strength at R.T, was 265 lbs./in. and at 200° F. was 188 lbs./in. and the failure of each was at the splice. The tensile strength of the cloth backing alone at R.T. was 272 lbs./in. and at 200° F. was 188 lbs./in.

EXAMPLE 11

A butt splice was made in the same way as in Example 1 except that the coated abrasive sheet material was 272L Imperial Microfinishing film commercially available from 3M Co. In the Tensile Test, its tensile strength at R.T. was 84 lbs./in. and at 200° F. was 43 lbs./in., and the failure of each was at the splice. The tensile strength of the film backing alone at R.T. was 94 lbs./in., and at 200° F. was 54 lbs./in.

Various modifications may be made without departing from the scope of the claims. For example, a belt usually has only one splice, but it may have several. A segment belt with 2–3 splices may be made to provide a wide belt.

What is claimed is:

1. An endless abrasive belt or cone comprising a length of coated abrasive sheet material which includes a backing, said length of coated abrasive sheet material having first and second ends, the first and second ends spliced together by an adhesive derived from an aqueous adhesive dispersion consisting essentially of polyester polyurethane polymers having backbones, the backbones having a plurality of ionic groups therein, and a crosslinking agent.

2. An endless abrasive belt or cone as defined in claim 1 wherein the backing comprises paper impregnated with a resinous material.

* * * * *